US008932118B2

(12) United States Patent
Shuren et al.

(10) Patent No.: US 8,932,118 B2
(45) Date of Patent: Jan. 13, 2015

(54) BATCH RE-LOAD OF COIN RECYCLER

(75) Inventors: Thomas E. Shuren, West Chester, PA (US); Neil M. Young, Downingtown, PA (US); Andrew M. Yellop, Berkshire (GB); David Michael Furneaux, Reading (GB); Karen Aurelius, Nr Reading (GB)

(73) Assignee: MEI, Inc., Malvern, PA (US)

( * ) Notice: Subject to any disclaimer, the term of this patent is extended or adjusted under 35 U.S.C. 154(b) by 640 days.

(21) Appl. No.: 12/303,904

(22) PCT Filed: Jun. 6, 2007

(86) PCT No.: PCT/US2007/070499

§ 371 (c)(1),
(2), (4) Date: Jun. 2, 2010

(87) PCT Pub. No.: WO2007/146705

PCT Pub. Date: Dec. 21, 2007

(65) Prior Publication Data

US 2010/0234985 A1 Sep. 16, 2010

Related U.S. Application Data

(60) Provisional application No. 60/812,257, filed on Jun. 9, 2006.

(51) Int. Cl.

| | |
|---|---|
| ***G07D 1/00*** | (2006.01) |
| ***G07D 9/00*** | (2006.01) |
| ***G07F 9/08*** | (2006.01) |

(52) U.S. Cl.

CPC ... *G07D 9/00* (2013.01); *G07F 9/08* (2013.01)
USPC ..... 453/57; 453/6; 453/10; 453/12; 453/49; 453/61

(58) Field of Classification Search

CPC ..... G07D 11/0045; G07D 11/0051; G07D 11/0069; G07D 11/0078; G07F 19/00; G07F 9/04
USPC ..... 453/7, 11, 56, 3, 5, 6, 9, 10, 12, 49, 453/50–54, 57; 221/186–190, 200–205, 221/208, 209, 263–266, 277, 288, 306
See application file for complete search history.

(56) References Cited

U.S. PATENT DOCUMENTS

| | | | | |
|---|---|---|---|---|
| 4,635,661 | A | 1/1987 | Uematsu et al. | |
| 5,366,407 | A * | 11/1994 | Sentoku | 453/3 |

(Continued)

FOREIGN PATENT DOCUMENTS

| | | | |
|---|---|---|---|
| EP | 1367544 | A2 | 12/2003 |
| JP | 2003217001 | A | 7/2003 |
| WO | WO-9733257 | A1 | 9/1997 |

OTHER PUBLICATIONS

Supplementary European Search Report dated Mar. 23, 2012 of corresponding European patent application No. 07798164. 5.

*Primary Examiner* — Jeffrey Shapiro
(74) *Attorney, Agent, or Firm* — Mintz Levin Cohn Ferris Glovsky and Popeo, P.C.

(57) ABSTRACT

Replenishing coins in a coin store associated with a coin handling device includes feeding a batch of coins from a bulk coin store to a receptacle near the coin handling device, delivering coins from the receptacle to the coin handling device and routing at least some of those coins from the coin handling device to the coin store associated with the coin handling device.

41 Claims, 18 Drawing Sheets

(56) References Cited

U.S. PATENT DOCUMENTS

| | | | | |
|---|---|---|---|---|
| 5,842,916 | A * | 12/1998 | Gerrity et al. | 453/57 |
| 6,179,703 | B1 | 1/2001 | Knutsson et al. | |
| 6,318,537 | B1 | 11/2001 | Jones et al. | |
| 6,328,646 | B1 * | 12/2001 | Abe et al. | 453/56 |
| 6,484,884 | B1 * | 11/2002 | Gerrity et al. | 209/233 |
| 6,637,576 | B1 * | 10/2003 | Jones et al. | 194/216 |
| 6,899,214 | B2 * | 5/2005 | Morikawa | 194/302 |
| 2003/0006121 | A1 * | 1/2003 | Lee et al. | 194/206 |
| 2004/0093117 | A1 * | 5/2004 | Daout et al. | 700/231 |
| 2004/0231956 | A1 | 11/2004 | Adams et al. | |
| 2005/0150740 | A1 * | 7/2005 | Finkenzeller et al. | 194/207 |

* cited by examiner

BATCH RE-LOAD OF COIN RECYCLER

CROSS REFERENCE TO RELATED APPLICATIONS

This application is a national phase filing under 35 U.S.C. §371 of International application number PCT/US2007/070499, filed Jun. 6, 2007, which claims priority from U.S. Provisional application No. 60/812,257 filed Jun. 9, 2006. The contents of the prior applications are incorporated herein by reference.

BACKGROUND

To facilitate payment in connection with transactions for goods or services, automated retail facilities (e.g, point-of-sale/self check-out counter) may be provided with coin mechanisms into which a customer deposits coins (e.g., genuine coins or tokens). Such coin mechanisms typically have one or more coin tube stores into which an accepted coin is routed after its denomination and authenticity have been determined. Change may be delivered to a customer from the coin tube stores. The coin mechanism also may have an associated cash box to which accepted coins are routed if the corresponding coin tube store is full or if there no coin tube store for coins of the particular denomination.

For many coin mechanisms, the capacity of the coin tube stores is insufficient to cover the average daily volume of transactions in a retail environment. Although the coin tube stores may be replenished partially each time a customer deposits coins, it is likely that the system will dispense more coins to be paid out (e.g., as change) than are deposited by the customers.

SUMMARY

Replenishing coins in a coin store associated with a coin handling device includes feeding a batch of coins from a bulk coin store to a receptacle near the coin handling device, delivering coins from the receptacle to the coin handling device and routing at least some of those coins from the coin handling device to the coin store.

In a particular aspect, a coin recycler system includes one or more coin handling devices and at least one coin store associated with the coin handling device(s), including at least one coin store from which coin(s) can be dispensed. The system also includes a receptacle near the coin handling device, and a bulk batch re-loader module to feed a batch of coins to the receptacle for automated delivery from the receptacle to the coin handling device(s).

In some implementations, the bulk batch re-loader module includes a bulk coin store and is operable to feed a small batch of coins from the bulk coin store to the receptacle. For example, the bulk coin store can contain a predetermined mix of coins of multiple denominations. The proportion of each type of coin in the predetermined mix of coins can be substantially matched to proportions in which each type of coin is dispensed from the one or more coin stores on an average periodic basis (e.g., on an average hourly, daily, weekly or monthly basis). In a particular implementation, the one or more coin handling devices include a coin changer having coin tube(s) for storing coins of specified types therein. The types of coins in the mix of coins in the bulk coin store can be limited to the specified types of coins that are stored in the coin tube(s).

The bulk coin store can take various forms. In some implementations, the bulk coin store includes a rotatably mounted drum containing a scooper that is arranged to rotate with the drum, and that is operable to scoop coins in the drum during rotation and to direct the scooped coins through a hole in the drum.

Various other features and advantages that are present in some implementations will be readily apparent from the following detailed description.

DETAILED DESCRIPTION

The disclosure relates to managing the re-loading of coins in a coin recycler.

The following paragraphs describe various implementations of a bulk batch re-loader module that can facilitate loading or re-loading of coins into coin stores from which coins can be dispensed. Although the particular implementations described below incorporate coin changers that include one or more coin tubes for storing and dispensing coins as change, other types of coin handling devices (e.g., coin acceptors) can be incorporated into other implementations.

As used herein, the term "coin" includes, but is not limited to, any coin (whether valid or counterfeit), token, slug, washer, or other similar metallic object of value that can be used by an individual in an attempt to operate a coin-operated device or system.

Figure 1:
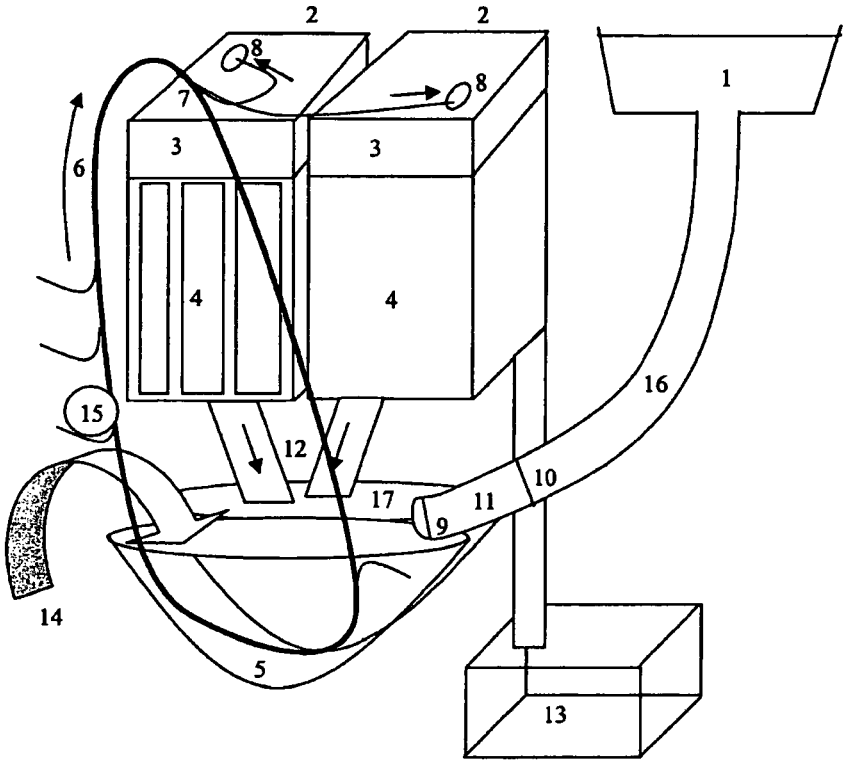
FIG. 1 illustrates an example of a coin recycler system.

As shown in FIG. 1, an input receptacle such as a tray 5 near one or more coin handling devices 2 (e.g., a pair of Cash-Flow™ type coin changers manufactured by MEI, Inc.). A batch of coins from a bulk coin store 1 can be delivered under the control of a microprocessor located, for example, in one of the coin mechanisms 2 to input tray 5 to replenish the coin tubes 4. The coin mechanisms also are provided with a chain loop or other type of elevator 6 to carry coins from the tray 5 to a separator (i.e., coin sorter) or diverter 7 which directs the coins into one or the other of the coin mechanisms. The coins may be sorted by the diverter 7 based, for example, on their size (e.g., diameter). Coins that are not directed by the coin mechanisms 2 to the coin tube stores 4 can be directed to a cash box 13. Change can be delivered from the coin tubes to an output receptacle such as tray 17. Dispensers allow coins to be dispensed from the coin tubes. The coin mechanisms 2 can be mounted back-to-back The recycler system can be implemented by adapting one or more existing coin changers as components of the system, as in the illustrated implementations. Alternatively, the recycler system can be custom designed to incorporate the functionality of a coin changer without the coin changer forming a separate, pre-existing unit. As used herein, the phrase "coin changer" can include either situation. In either case, the coin changer can operate in at least the following two modes: a first accept-payment mode of operation and a second coin tube reloading mode of operation.

In the accept-payment mode of operation, the coin changer checks inserted coins (if any) for at least one of denomination and authenticity and directs rejected coins to an output tray. Accepted coins are directed to one of the coin tubes (or, if the coin tube for the coin denomination is full or there is no corresponding coin tube, then the coin can be directed to the cash box). The first mode of operation can be used, for example, to accept payment from a customer for items or services being purchased. Regardless of whether the customer pays with coins (inserted into the coin changer) or banknotes (inserted, for example, into an associated banknote validator), change can be returned to the customer in the form of one or more coins from the coin tubes 4.

The coin tube reloading operation can be used to compensate for the deficit between the intake of coins (which may be relatively low) and the payout of coins as change (which, over a period spanning multiple transactions, may be much greater than the intake of coins during the same period). Preferably, in the coin tube reloading mode of operation, all received coins are presumed to be authentic. The received coins are used to replenish the coin tubes. In the coin tube reloading mode of operation, coins that are rejected (e.g., because the corresponding coin tube is full or because of an intrinsic acceptance rate) are sent to the cash box.

To replenish the coin tube stores 4, the input tray 5 is closed (e.g., under control of the coin mechanism microprocessor or of another central controller) to prevent interference by a customer during the replenishing cycle. Coins from the bulk coin store 1 are allowed to pass through the funnel tube 16 to the input tray 5. Such action effectively emulates a user's manually depositing a handful of coins into the tray 5. In some arrangements, multiple bulk coin stores 1 can be provided for the group of coin mechanisms 2.

The coins in the tray 5 are carried by the elevator 6 from the input tray toward one of the entry slots 8 of the coin mechanisms by a coin diverter or separator that mutes the coins to the appropriate coin mechanism, for example according to their diameter. The use of multiple coin mechanism (rather than a single coin mechanism) can provide a greater number of coin tubes to allow for a greater variety of coin types or denominations. The passive separator/multiple coin mechanism arrangement can be replaced with a bespoke, multi-tube changer design.

As part of the reloading process, the coin stores 4 are loaded with smell batches of coins from the bulk coin store 1. The reloading process can be performed repeatedly, for example, at pre-set times, on a periodic basis, or on an as-needed basis such as when the capacity of one or more of the coin tube stores falls below a specified level. The reloading process reduces the effects of fluctuations in the number of coins returned as change and received as payment from customers, and compensates for the slow depletion of the tubes. The small batches of coins received from the bulk coin store 1 can have a randomly variable number of coins and can have include coins of different types of denominations. All the coins in the batch pass through one or the other of the coin mechanisms 2. During the reloading process, rejected coins, as well as coins for which there is no corresponding coin tube store 4, are sent to the cash box 13. Similarly, a coin is sent to the cash box if the corresponding coin store tube 4 is full. When change is returned to the user, it is sent from the coin mechanism to the output tray. In the normal mode of operation as a changer/recycler, when coins are provided by a user, any rejected coins are returned to the user.

Figure 2:
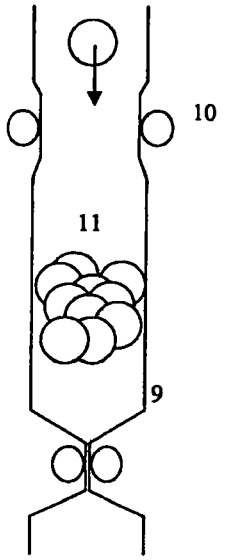
FIGS. 2 and 3 illustrate an example of a coin passage from a bulk coin store.
Figure 3:
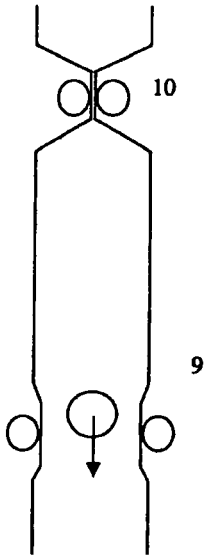

The small batch of coins delivered from the bulk coin store 1 to the input tray 5 need not have an exact count of coins each time. The batch of coins can be provided to the input tray 5 by allowing coins to pass from the bulk coin store 1 into the large funnel tube 16 by briefly opening an upper shutter door (or gate) 10 while a bottom door (or gate) 9 is closed (FIG. 2). The upper door 10 then is closed and the batch of coins is dropped into the input tray 5 by opening the bottom door 9 (FIG. 3). Alternately opening and closing the doors 9, 10 in such a manner allows a section of the funnel tube 16 (the batch forming section 11) to isolate the batch of coins temporarily. Even if the upper door 10 does not completely close (for example, if coins become stuck across the closing area), additional coins will, nevertheless, be prevented from dropping to the insert tray 5.

The funnel tube 16 can be made, for example, of a flexible material such as plastic or rubber. To close one of the doors 9, 10, the flexible material can be pinched by an external trap controlled, for example, by two external rods driven by an actuator (e.g., solenoid). Other types of chutes or passages can be used to carry the batch of coins from the bulk coin store to the input tray. Likewise, other door or gate arrangements can be used.

The batch of coins may include a single denomination or a mix of several denominations of coins. Preferably, the batch of coins is limited to the type of coins that can be stored in the tube stores 4 of the coin mechanisms 2. In some cases, it is desirable to have a mix of controlled proportions of coin denominations as they can vary from country to country, depending on the value of the coins in a national coin set. The proportion of each type of coin in the predetermined mix of coins can be substantially matched to proportions in which each type of coin is dispensed from the coin tubes on an average daily basis. The mix of coins may be prepared in advance, for example, with coin sorting machines at the back office. The mixed batch then can be loaded into the bulk coin store 1.

As illustrated in FIG. 1 separate input/output trays 5, 17 are provided. In other implementations, a single tray can be provided for both functions (i.e., input and output). A single tray configuration can be more compact, but may make it more difficult for the customer to pick up coins manually around the elevator pick-up area because of the narrowness of some designs. In such situations, a separate output tray may be preferred.

In some implementations, the bulk coin store 1 is removable. To load the system with coins at the start of a day, for example, a filled bulk coin store 1 would be attached to the system as shown in FIG. 1. The bulk coin store 1 can be closed securely, for example, by key locks or electronic locks and can have a smart tag chip memory to store information such as electronic access key information and cash content amount. Although the bulk coin store 1 may drop an imprecise number of coins (which, on occasion, may include multiple denominations), the system still can calculate the total cash balance in various storage areas (e.g., bulk storage, coin mechanism storage, cash-box) at all times because its output is processed by the coin mechanism(s). For example, after the bulk coin store drops coins into the tray, those coins are passed through the coin changer(s). The coin changers can keep track of the number of coins of each denomination and/or the total amount received during a particular re-load process. That information then can be used to track the number of cons of each denomination and/or the total amount remaining in the bulk coin store.

Each coin mechanism 2 is capable of managing its own coin content. When a particular denomination's coin level gets too low, a signal trigger generated by the corresponding coin mechanism initiates the recycling process. For situations in which two coin mechanisms are connected, two hardware lines can be combined in an OR fashion. In other implementations, the input/output signals of the coin mechanisms can be driven by a central controller or they can be connected to a serial bus, for example, such as a multi-drop bus (MDB) adapted to the standard addressing scheme to allow more that one coin mechanism. Alternatively, an additional system with computing means (e.g., a microprocessor) can handle the global storage status and trigger the need to refill the tubes based on a predetermined minimum level threshold or based on a predictive depletion rate. The predictive depletion rate can be based, for example, on measurements of the actual rates and distribution of coins.

Smart radio-frequency identification (RFID) chips as well as other forms of memory chips, including contact or contactless types, can be provided at various locations in the system to maintain cash balance data, individually or collectively, for each of the coin storage areas.

A signal from coin mechanisms 2 causes a batch of coins to be delivered to the tray from the bulk coin store 1. The coins in the tray are used to replenish the coin tube stores 4 in the coin mechanisms 2. At the end of the batch refill process, the cycle can be repeated if necessary (e.g., if a low-level signal by coin denomination is not cleared).

Measurement of actual uses of each coin denomination can be used to adjust the optimal mix of coins to be loaded into the bulk coin store 1.

To improve cash management, the bottom door 9 should have an electronic lock that can be opened only by a system signal based on a batch demand.

The coin recycling system described above can be connected to a point-of-sale cash register system or self-check-out system via a protocol. Examples of such protocols include Unified Point of sales protocol (UPOS), OLE version of the POS protocol (OLE), and Java version of the POS protocol (JPOS). In some arrangements a dedicated computer unit can control the system, including other components of a self check-out terminal.

Various advantages may be present in some implementations. For example, as discussed above, the batch reloading process does not require a precise count by the hopper of the coins loaded into the system. Furthermore, the overall size of the system can be relatively small.

Figure 4:
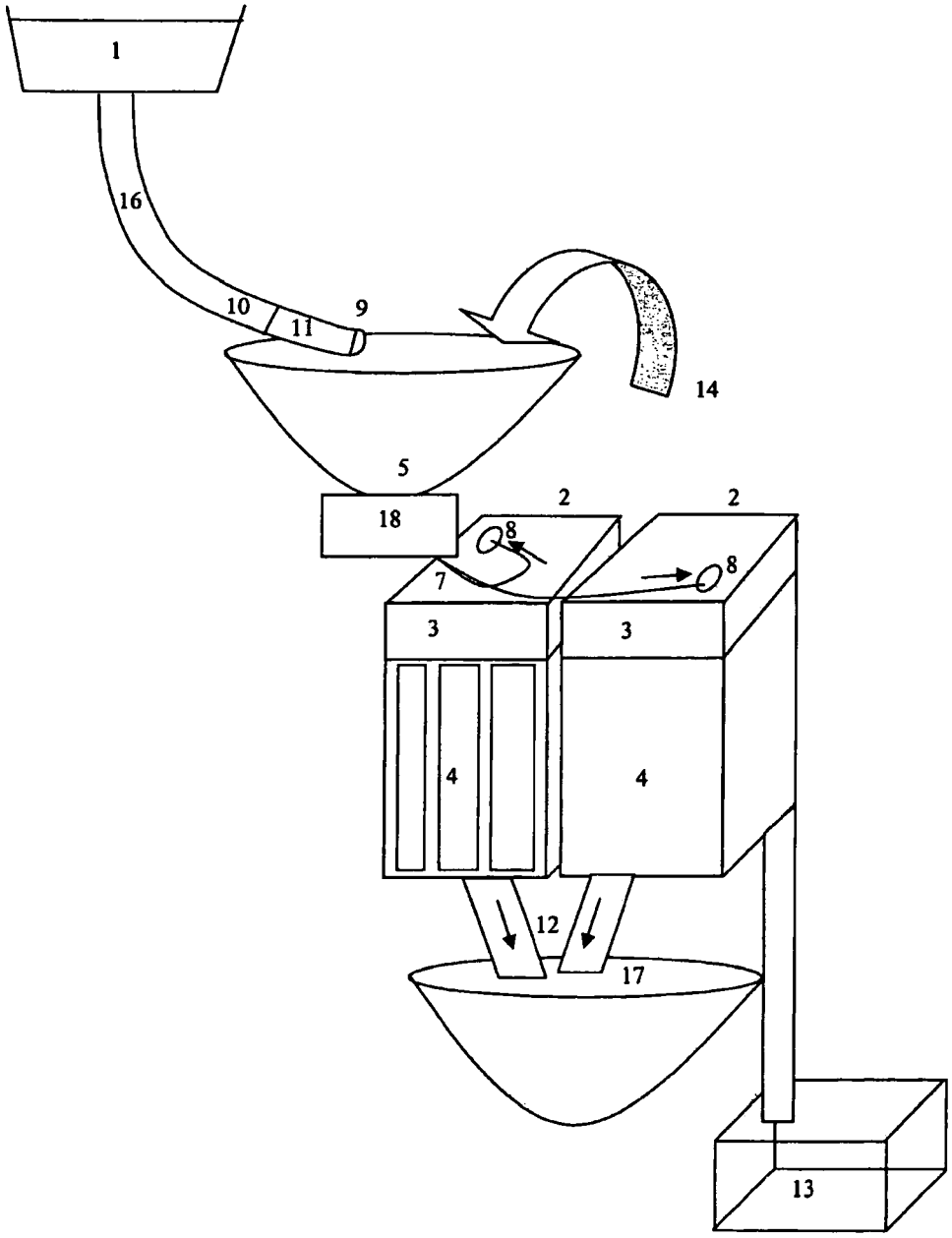
FIG. 4 illustrates another example of a coin recycler system.
Figure 5:
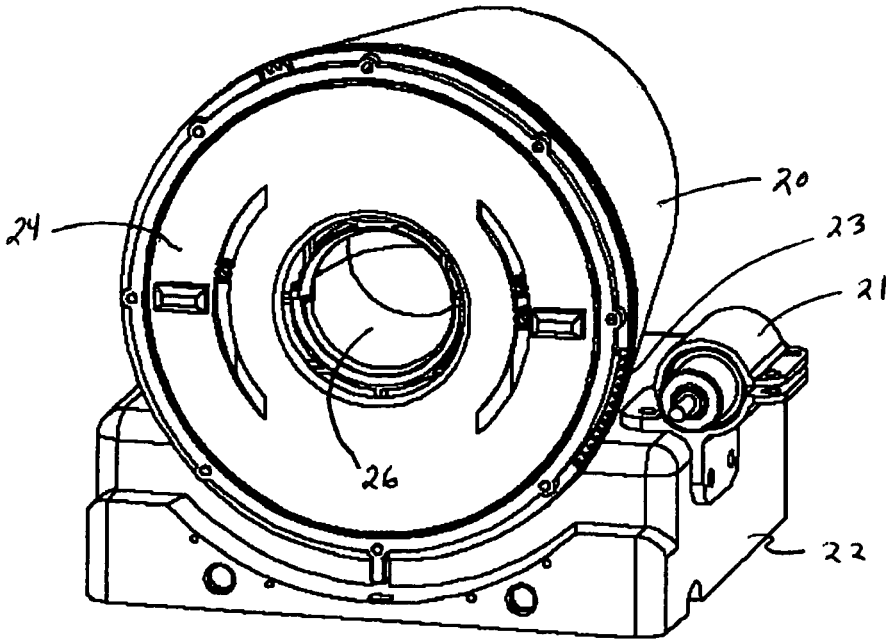
FIG. 5 illustrates an example of a bulk coin store.
Figure 6:
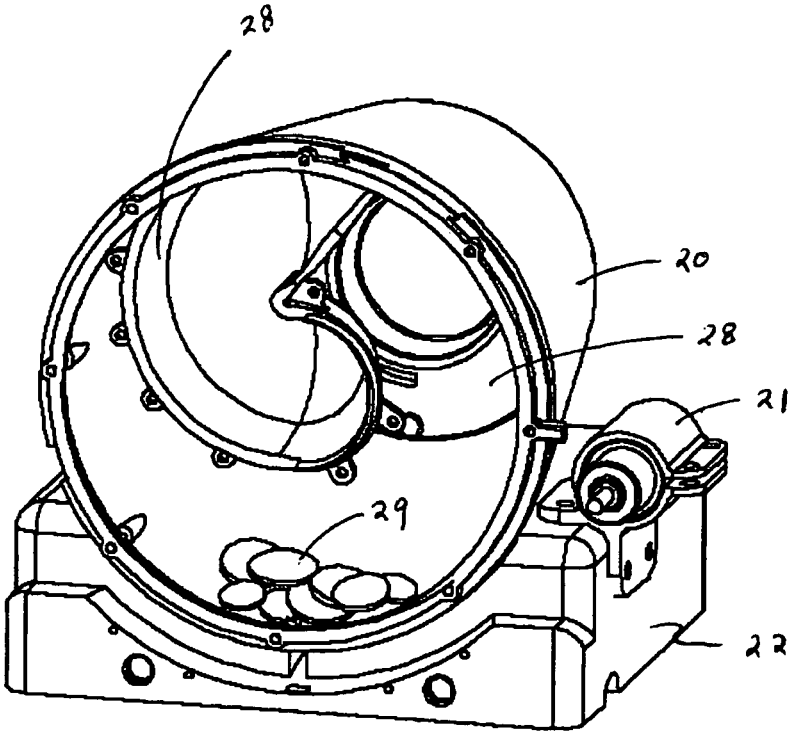
FIGS. 6 through 10 illustrate operation of the bulk coin store of FIG. 5, with a bottom plate removed to facilitate understanding.

According to another implementation, illustrated in FIG. 4, the batch of coins is dropped from a bulk coin store 1 located above the coin mechanism(s) 2 into a tray 5, also positioned above the coin mechanism(s). Such an implementation can avoid the need for an elevator to carry the coins upward so that they can be deposited into the coin mechanism(s). A singulator device 18 selects one coin at a time to be fed into the coin mechanism. Examples of such devices include coin hoppers designed to eject one coin at a time.

According to another modification, particularly suitable for countries such as Japan where the smallest coin is too small to be handled reliably in standard coin changers, one of the coin changers 2 can be replaced by a coin acceptor with a coin hopper to hold a single type of coin. In that case, a small coin (selected, for example, by size using a coin sorter) would be diverted to the hopper (through a coin acceptor) instead of the coin changer. The coin hopper serves the same role as a coin tube, but in another compact form.

The system also can be designed to include a manual loading mode in which, instead of batch loading coins from the bulk feeder 1, a batch of coins is dropped manually into the input tray 5 and then loaded automatically into the coin mechanism(s). The process is similar to the situation in which a regular user (e.g., a customer) drops coins into the tray 5, except that the accounting differs (i.e., the coins are provided for reloading the coin tubes 4 instead of for payment).

Another implementation of a bulk store is illustrated in FIGS. 5 through 12. The bulk coin store includes a rotatable drum 20 mounted on a docking station 22. In the illustrated example, the drum 20 has a tapered shape (e.g., a conical frustum), with the wider end at the bottom 24 of the drum. In other implementations, the drum 20 has a cylindrical shape. When mounted on the docking station 22, the drum preferably is slightly inclined to allow coins in the drum to move, under the weight of gravity, toward the bottom plate 24 of the drum. The bottom plate 24 includes a gated exit 26 through which coins slide or fall, for example, onto a chute or other passage as they travel from the drum to the input receptacle (e.g., tray 5 in FIG. 1). In some implementations, the coins leaving the exit 26 fall directly onto the input tray. In the illustrated example, the top plate 28 of the drum 20 (the inside of which can be seen, for example, in FIG. 6) has a lockable, closable access door (not shown) through which a predetermined mix of coins can be inserted into the drum.

The dimensions of the drum 20 and material(s) from which it is made depend on the volume and weight of coins the drum is designed to hold. Nevertheless, in a particular implementation, the drum 20 is about eight inches tall (from the bottom end to the top end), has about a five-inch diameter at the narrow end and about an eight-inch diameter at the wide end, and is made of metal and/or plastic materials. Preferably, the drum should be made of a material such that it will not burst open in the event it were to fall onto the floor when full of coins.

The drum 20 can be removed from the docking station 22. One or more handles can be attached, for example, to the top end of the drum 20 to facilitate carrying an empty drum or a drum filled with coins. Preferably, when the drum 20 is to be removed from the docking station 22, the exit 26 is closed securely, for example, by a shutter.

As explained below, inside the drum 20 is a coin scooper that is operable to scoop coins from the mix of coins in the drum. The scooped coins then are dispensed through the opening 26 in the bottom end 24 of the drum. The scooper is mounted or otherwise attached to the inside of the drum such that the scooper rotates together with the drum. At least in some cases, rotating the drum can provide one or more of the following advantages. First, the coins remaining in the drum can be continually mixed. That can help maintain the relative proportion of each type of coin in the predetermined mix of coins as coins are dispensed from the drum or as a new batch of coins is added to the drum. Second, rotating the drum can help reduce the force that otherwise would occur on the front surface of the scooper as it attempts to scoop coins. Third, rotating the drum can help avoid coins becoming jammed under the edge of the scooper.

The periphery of one or both ends of the drum can include teeth 23 that are engaged by the motor 21 to drive the drum 20 and cause it to rotate. In the illustrated example, the bottom plate 24 of the drum 20 is static and does not rotate as the drum itself is rotated. A controller (not shown) can provide the various control signals to control, for example, operation of the motor 21.

FIGS. 6 through 10 illustrate a first example of a scooper 28 having a spiral or snail shell shape when viewed from the bottom end of the drum 20. In FIGS. 6 through 10, the bottom plate 24 of the drum 20 is removed so that the scooper 28 is visible inside the drum. For purposes of illustration, only a few coins 19 are shown at the bottom of the drum 20. However, initially, the drum can be substantially filled with coins, and then replenished as needed.

Figure 12:
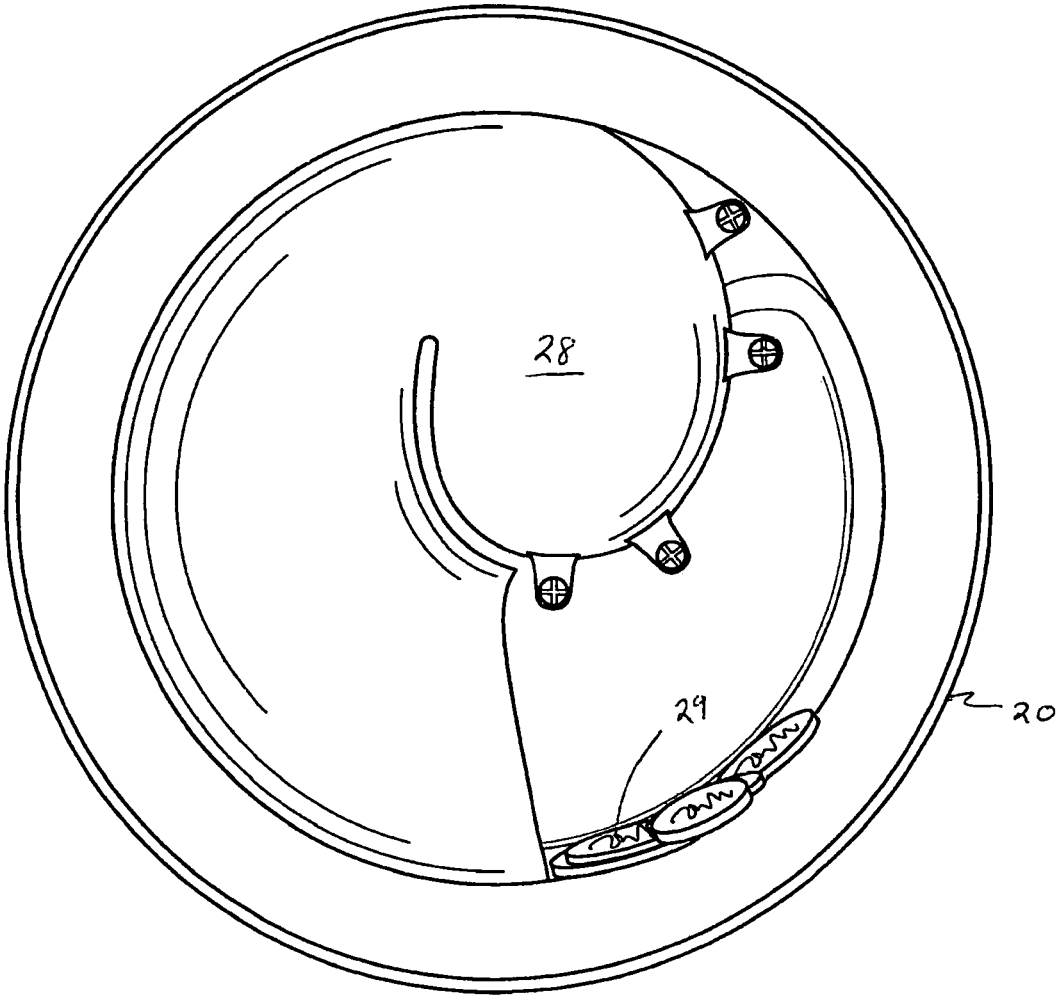
FIG. 12 illustrates details of a scooper in the bulk coin store of FIG. 5.
Figure 13:
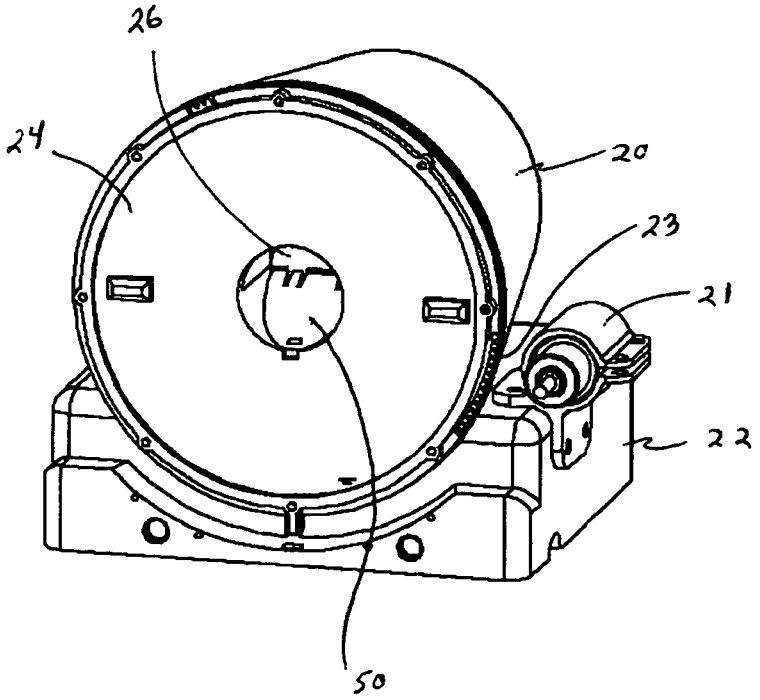
FIG. 13 illustrates another example of a bulk coin store.

FIG. 12 illustrates the scooper 28 when viewed from the top end of the drum 20 looking down onto the top of the scooper. The scooper 28 can be formed as a hollow tube with an open end adjacent the drum's bottom plate 24. The other end of the scooper 28 is aligned with the opening 26 at the centre of the bottom plate 24.

Figure 7:
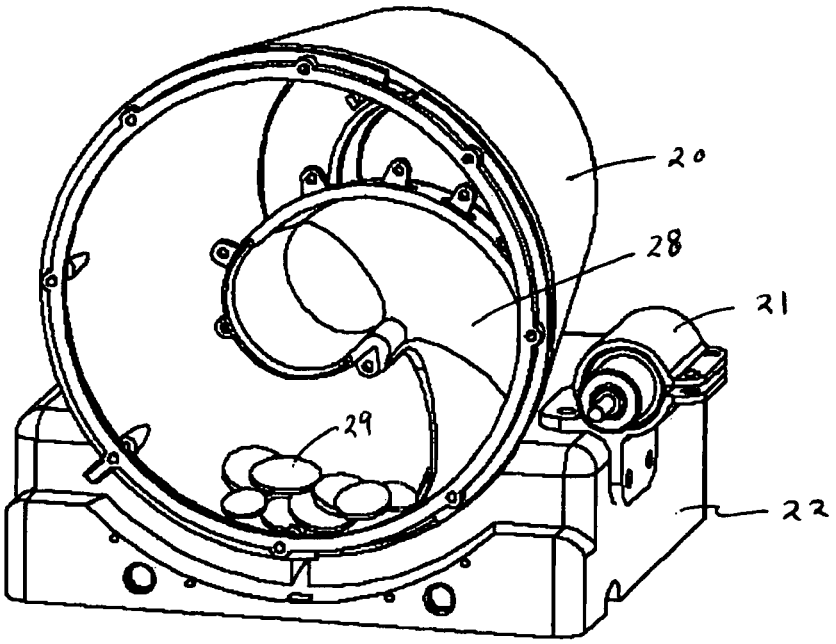
Figure 8:
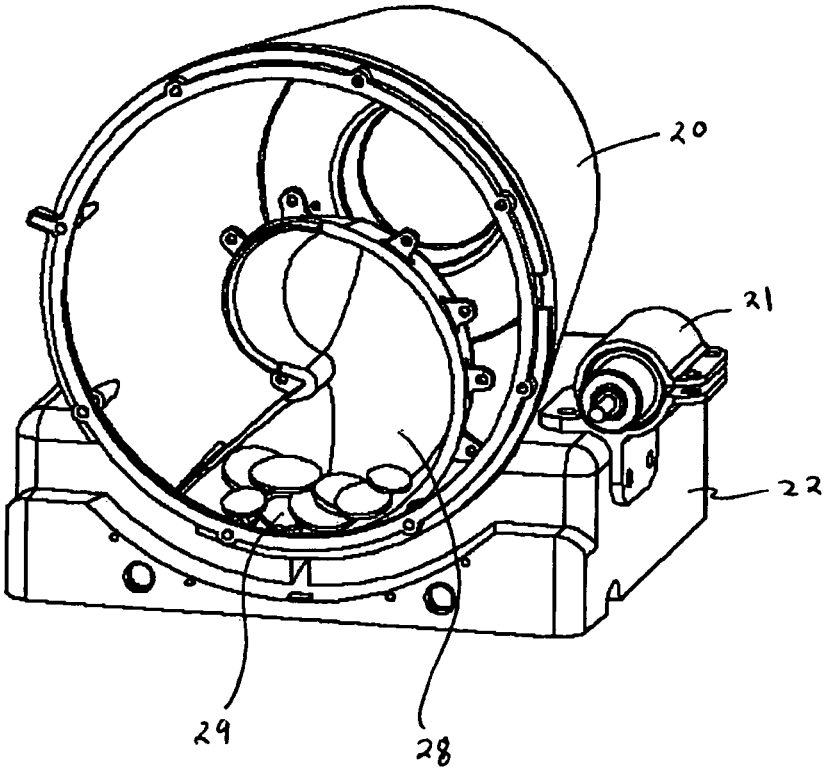
Figure 9:
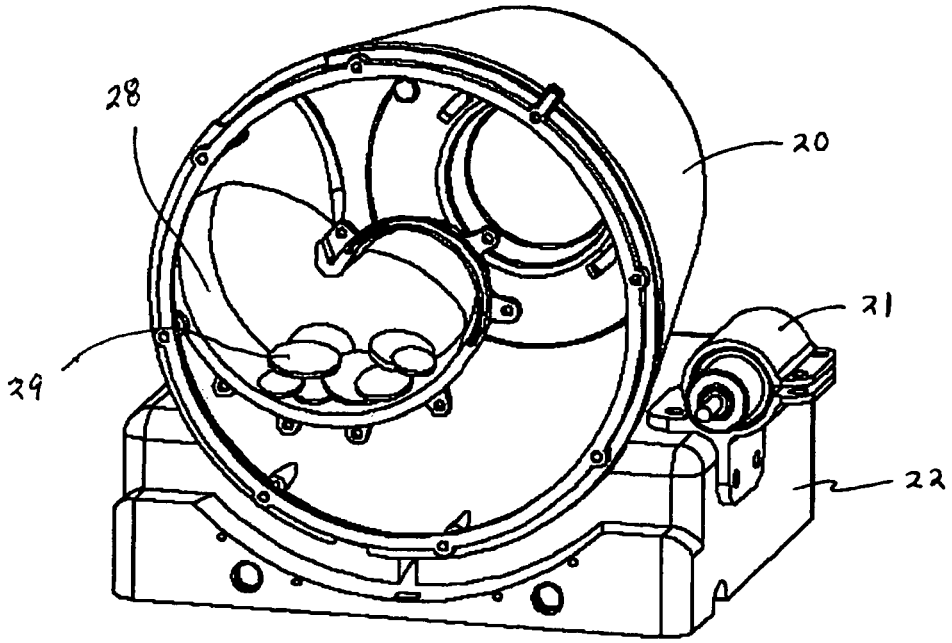
Figure 10:
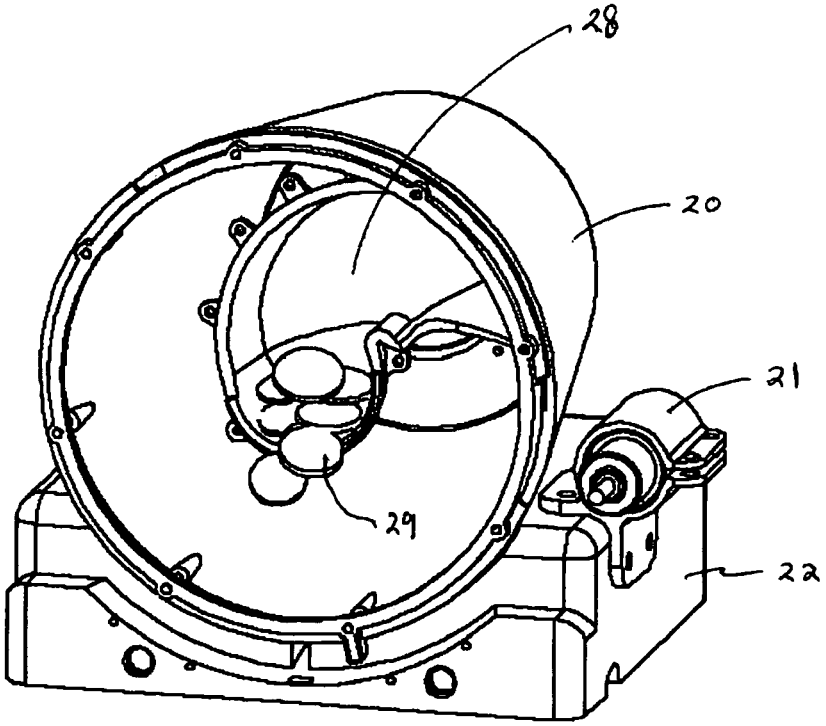
Figure 11:
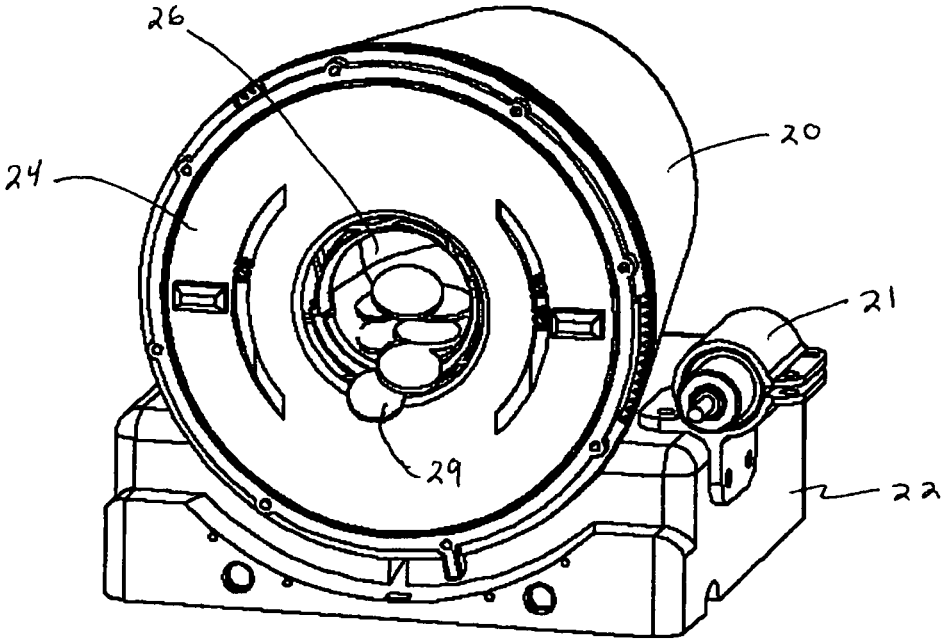
FIG. 11 illustrates operation of the bulk coin store of FIG. 5.

During operation, as the drum 20 and the scooper 28 rotate (clockwise, in the illustrated example), coins 29 slide, or are pushed, into the scooper (FIGS. 7 and 8). As the drum 20 and scooper 28 continue to rotate (FIGS. 9 and 10), the coins 29 in the scooper fall under the weight of gravity toward the other end of the scooper, which is aligned with the opening 26 in the drum's bottom plate 24 (see FIG. 11, which shows the drum 20 with the bottom plate 24 in place). At the same time, a mechanical system, which can include a cam, causes the gated exit 26 to open so that the coins can pass through the opening. The coins that were scooped up by the scooper pass through the opening 26 and fall down the chute or other passage (not illustrated in FIGS. 5-11) toward an input receptacle (e.g., tray 5 in FIG. 1) from where they can be transported to coin handling device(s) for storage in the associated coin stores. The opening at the exit 26 can then be closed again. In some implementations, the opening and closing of the gated exit can be controlled, for example, by signals from a microcontroller.

Preferably, each rotation of the drum 20 and the scooper 28 constitutes a coin dispense cycle during which a batch of coins is dispensed. If the microprocessor in the coin handling device(s) determines that additional coins are needed to refill the coin store(s), then the microprocessor can send a signal to initiate another coin dispense operation from the drum 20.

The implementation illustrated in FIGS. 5 through 12 can pick up even the few coins that remain in the drum 20 as it becomes nearly empty of coins. However, as the number of coins in the drum 20 becomes few, the number of coins that are scooped into the scooper 28 tends to become less than when the drum is full.

Another implementation, illustrated in FIGS. 13 through 19, can help provide more uniform scooping and dispensing of coins from the drum 20. In this case, the drum 20 includes a scooper 40 shaped as a right-angled arm with a cut-out region 42 on one side to allow coins to enter the scooper. As can be seen in FIGS. 15-18, inside the scooper 40 is a U-shaped inner wall 44 with an opening 48 (see FIG. 18). When the drum 20 is mounted in the docking station 22, the opening 48 of the inner wall 44 faces upward. The U-shaped inner wall 44 does not rotate with the drum 20 and the rest of the scooper 40. Instead, the inner wall 44 remains in a fixed position as the drum 20 and scooper 40 rotate.

Figure 14:
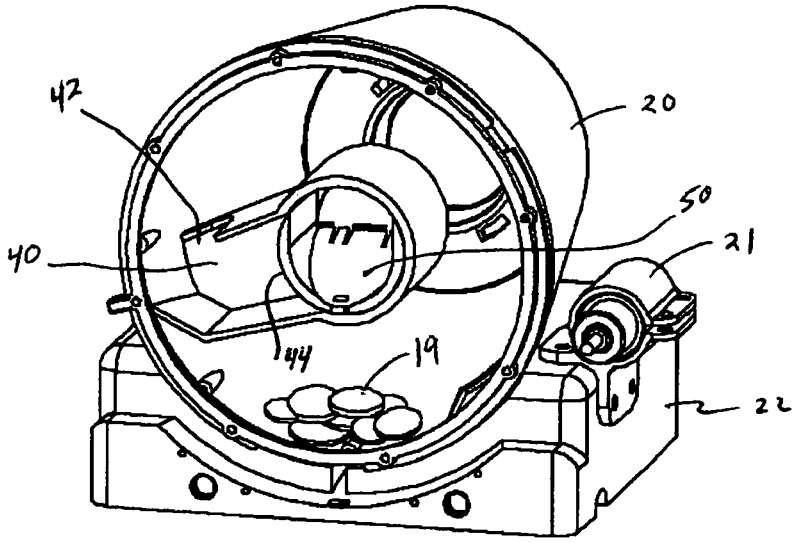
FIGS. 14 through 18 illustrate operation of the bulk coin store of FIG. 13, with a bottom plate removed to facilitate understanding.
Figure 15:
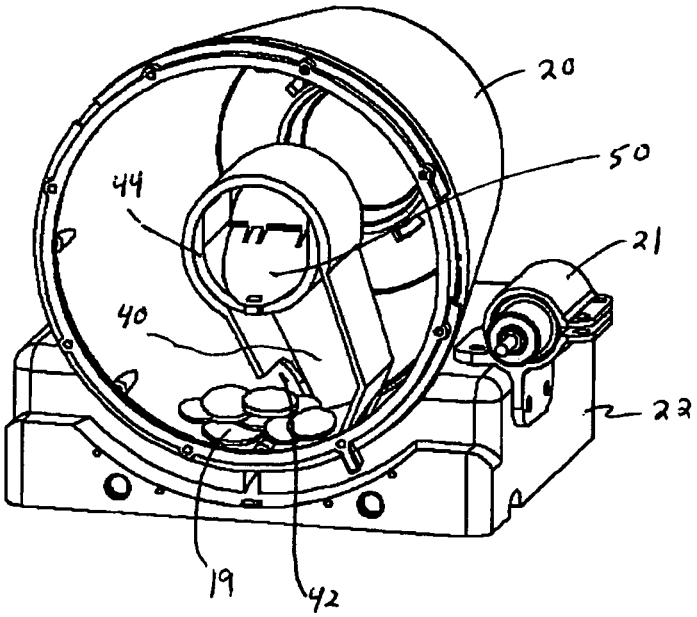
Figure 16:
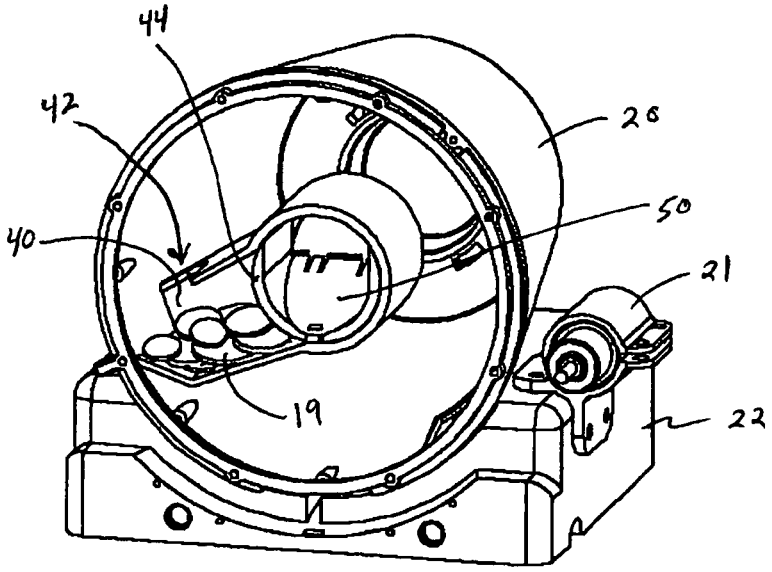
Figure 17:
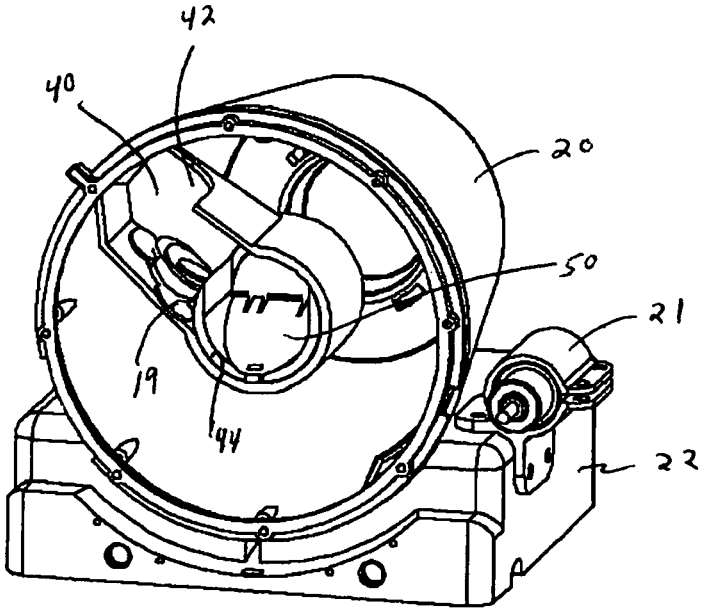
Figure 18:
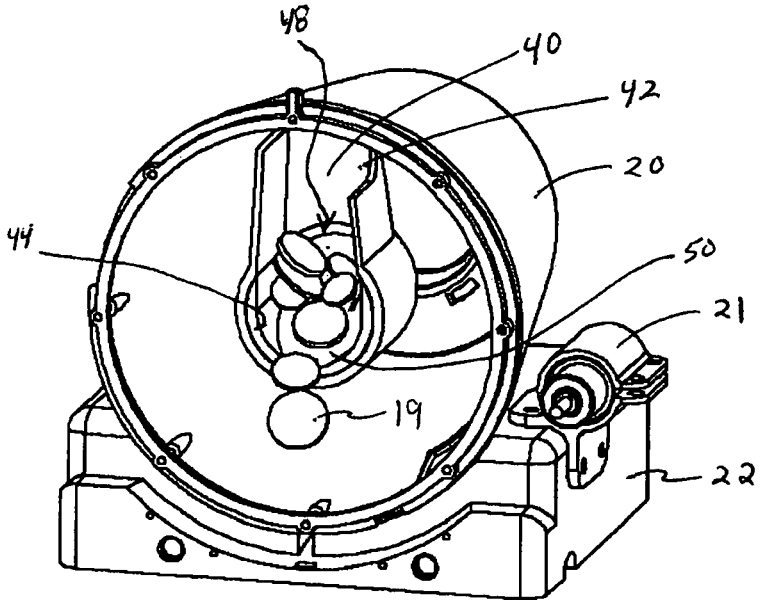
Figure 19:
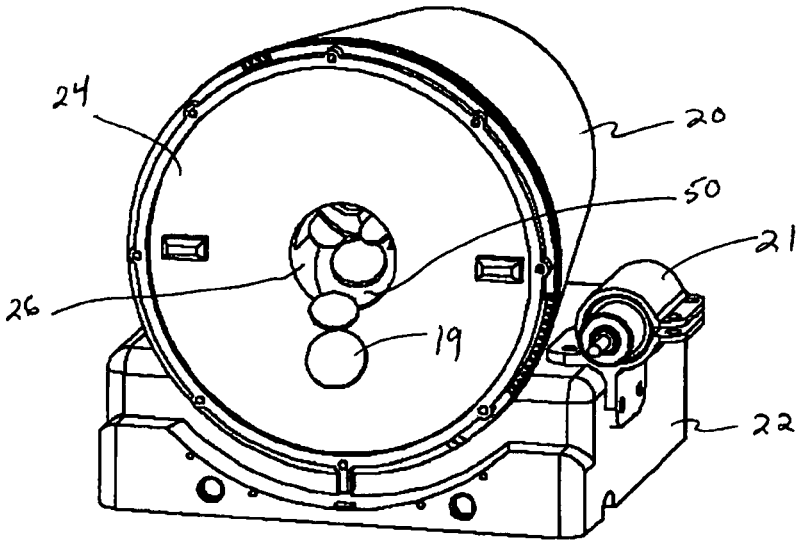
FIG. 19 illustrates operation of the bulk coin store of FIG. 13.

As the drum 20 and scooper 40 rotate clockwise from the position illustrated in FIG. 14 through the position illustrated in FIG. 15, coins slide, or are pushed, into the scooper. The drum 20 and scooper 40 continue to rotate clockwise through the positions illustrated in FIGS. 16 and 17. The inner wall 44 prevents the coins 19 in the scooper 40 from moving into the interior area defined by the inner wall. However, when the scooper 40 reaches the position shown in FIG. 18, the coins 19 in the scooper fall (under the weight of gravity) through the opening 48 in the inner wall 44. An inclined surface 50 within the area defined by the inner wall 44 is oriented to direct the coins toward the opening 26 in the bottom plate 24 of the drum 20 (see FIG. 19). In some implementations, one rotation of the drum 20 constitutes a coin dispense operation which allows coins to be scooped from the drum and directed, for example, via a chute or other passage to an input receptacle (e.g., tray 5 of FIG. 1) from where they can be transported to the coin handling device(s) for storage in associated coin stores. The implementation of FIGS. 13-19 can result in a fairly uniform number of coins being scooped into the scooper 40.

In some situations it may be desirable to mix the coins in the drum 20 separately from a coin dispense operation. That can be accomplished, for example, by rotating the drum in a counter-clockwise direction so that any coins in the drum become mixed. Occasions may arise where it is becomes desirable to add coins of certain type to the coins remaining in the drum. In such a situation, coins can be added to the drum through the access door in the top plate of drum 20.

The foregoing implementations can be particularly advantageous when a predetermined mix of coins is placed in the drum 20 or other bulk coin store such as the bulk coin store 1 of FIG. 1. For example, the proportion of each type of coin in the predetermined mix of coins can be substantially matched to the proportions in which each type of coin is dispensed from the coin store(s) associated with the coin handling device(s) on an average daily or other periodic basis. However, the various implementations described here also can be used with a random mixture of coins or with coins of only a single type.

The foregoing implementations of FIGS. 5 through 19 employ a rotatable drum having a scooper that rotates with the drum. As explained above, using a rotatable drum can provide various advantages in some implementations. Nevertheless, in some implementations, the scooper can be driven to rotate independently of the drum to pick up coins which fall, under the weight of gravity, toward the opening in the bottom plate of the drum.

Other implementations are within the scope of the claims.

What is claimed is:

1. A coin recycler system comprising:

one or more coin changers operable to determine at least one of the denomination or authenticity of an inserted coin;

at least one coin store associated with the one or more coin changers, including at least one coin tube store in which one or more coins can be stored and from which one or more coins can be dispensed;

a receptacle near the at least one or more coin changers; and a bulk batch re-loader module comprising a bulk coin store, wherein the bulk batch re-loader is operable to feed a batch of coins from the bulk coin store to the receptacle and operable to deliver the coins automatically from the receptacle to the one or more coin changers;

wherein the bulk coin store comprises a rotatably mounted drum containing a bottom plate with gated exit and a scooper arranged to rotate with the drum, the scooper operable, as the drum rotates, to scoop coins in the drum and to direct the scooped coins through the gated exit in the bottom plate of the drum to the receptacle.

2. The coin recycler system of claim 1 wherein the bulk coin store contains a predetermined mix of coins of multiple denominations.

3. The coin recycler system of claim 2 wherein the one or more coin changers include a coin changer having one or more coin tubes for storing coins of specified types therein, and wherein the types of coins in the mix of coins are limited to the specified types of coins.

4. The coin recycler system of claim 1 wherein the drum is inclined so the batch of coins can pass, under the force of gravity, through the exit.

5. The coin recycler system of claim 1 wherein the drum is operable so that the scooped coins can fall, under the force of gravity, through an exit in the drum to the receptacle.

6. The coin recycler system of claim 1 wherein the coin changer includes a processor to track a level of coins in the at least one coin store and to trigger a replenishing of coins in the at least one coin store from the bulk coin store if the level of coins goes below a predefined threshold.

7. The coin recycler system of claim 6 wherein the processor is operable to track the coin level using a predictive algorithm.

8. The coin recycler system of claim 1 including an output receptacle to receive coins dispensed from the at least one coin store.

9. The coin recycler system of claim 1 wherein the bulk batch re-loader module includes an elevator to lift coins from the receptacle for insertion into the coin changer.

10. The coin recycler system of claim 9 including:

first and second coin changers; and a coin sorter to direct coins from the elevator into one or the other of the coin changers.

11. The coin recycler system of claim 10 wherein the coin sorter is operable to sort the coins according to their diameter.

12. The coin recycler system of claim 9 wherein the elevator is operable to carry coins individually.

13. The coin recycler system of claim 12 wherein the elevator comprises a chain loop elevator.

14. The coin recycler system of claim 1 including a singulator device coupled to the receptacle to allow one coin at a time to be fed into the one or more coin changers.

15. The coin recycler system of claim 14 wherein the singulator device includes a coin hopper.

16. The coin recycler system of claim 1 wherein the one or more coin changers include a coin acceptor coupled to a hopper, and a coin changer, the coin recycler system further including a coin sorter to direct coins from the receptacle either to coin changer or to the coin acceptor.

17. The coin recycler system of claim 1 including an automated door that is movable to a position which prevents a user from placing coins into the receptacle during a coin replenishing operation.

18. The coin recycler system of claim 1 including a pathway from the bulk coin store to the receptacle, wherein the pathway includes one or more gates whose respective positions are controllable to allow coins from the bulk coin store to be delivered to the receptacle.

19. The coin recycler system of claim 1 wherein the coin changer includes a first accept-payment mode of operation and a second coin store reloading mode of operation, wherein in the first accept-payment mode of operation, the coin changer is operable to check inserted coins for at least one of denomination and authenticity and directs rejected coins to an output tray, and wherein in the second coin store reloading mode of operation, all received coins are presumed to be authentic.

20. The coin recycler system of claim 19 wherein in the second coin store reloading mode of operation, the coin changer is operable to send coins to a cash box when the at least one coin store tube is full.

21. The coin recycler system of claim 1 wherein the at least one coin tube is arranged to receive a coin after at least one of the coin's denomination and authenticity is determined by an associated one of the coin changers.

22. The coin recycler system of claim 1, further comprising a docking station, wherein the drum is removably mounted on the docking station.

23. The coin recycler system of claim 1, wherein the bottom plate does not rotate as the drum rotates.

24. The coin recycler system of claim 1, wherein the scooper is driven to rotate independent of the drum.

25. An automated method for replenishing coins in at least one coin tube in which one or more coins can be stored and from which one or more coins can be dispensed, the at least one coin tube being associated with one or more coin changers operable to determine at least one of denomination and authenticity of an inserted coin, the method comprising:

rotating, by a motor, a bulk coin store to mix a plurality of coins contained therein, the bulk coin store comprising a rotatably mounted drum containing a bottom plate with gated exit and a scooper arranged to rotate with the drum;

feeding, using the scooper, at least one of the plurality of coins from the bulk coin store to a receptacle near the one or more coin changers, the scooper operable, as the drum rotates, to scoop coins in the drum and to direct the scooped coins through the gated exit in the bottom plate of the drum to the receptacle; and delivering coins automatically from the receptacle to the one or more coin changers and routing at least some of those coins from the one or more coin changers to the at least one coin tube.

26. The method of claim 25 wherein the bulk coin store contains a predetermined mix of coins of multiple denominations.

27. The method of claim 26 wherein the proportion of each type of coin in the predetermined mix of coins substantially matches proportions in which each type of coin is dispensed from the one or more coin stores on an average periodic basis.

28. The method of claim 26 wherein the one or more coin changer include a coin changer having one or more coin tubes for storing coins of specified types therein, and wherein the types of coins in the mix of coins are limited to the specified types of coins.

29. The method of claim 28 including routing at least some of the coins inserted into the coin changer to the one or more coin tubes.

30. The method of claim 25 including:

tracking a level of coins in the at least one coin store; and triggering a replenishing of coins in the at least one coin store if the level of coins goes below a predefined threshold.

31. The method of claim 30 including triggering replenishment of coins to the at least one coin store based on a predictive algorithm for the level of coins in the at least one coin store.

32. The method of claim 25 including:

using an elevator to carry the coins from the receptacle to the one or more coin changers; and directing the coins carried by the elevator into the one or more coin changers.

33. The method of claim 32 including:

sorting coins from the elevator according to predetermined criteria; and subsequently directing coins from the elevator into one of a plurality of coin changers based on the sorting.

34. The method of claim 33 wherein the sorting includes sorting the coins from the elevator according to their diameter.

35. The method of claim 25 including causing a door to move automatically to a position which prevents a user from placing coins into the receptacle during a coin replenishing operation.

36. The method of claim 25 including controlling respective positions of gates to allow coins from the bulk coin store to be delivered to the receptacle.

37. The method of claim 25 including a first accept-payment mode of operation and a second coin-store reloading mode of operation, wherein in the first accept-payment mode of operation, the one or more coin changers check received coins for at least one of denomination and authenticity and direct rejected coins to an output tray, and wherein in the second coin-store reloading mode of operation, all received coins are presumed to be authentic.

38. The method of claim 37 wherein, in the second coin-store reloading mode of operation, the one or more coin changers send coins to a cash box when the coin tube is full.

39. The method of claim 25 wherein the batch of coins passes, under the force of gravity, through the gated exit in the bulk coin store to the receptacle.

40. The method of claim 39 rotating the bulk coin store to cause a scooper within the receptacle to scoop the batch of coins and to direct the scooped coins to the exit in the bulk coin store.

41. The method of claim 40 wherein the scooper scoops the batch of coins and directs the scooped coins to the exit in the bulk coin store during a single rotation cycle of the bulk coin store.

* * * * *